United States Patent [19]

Jones

[11] Patent Number: 4,501,341

[45] Date of Patent: Feb. 26, 1985

[54] LOW FREQUENCY MUFFLER

[76] Inventor: Adrian D. Jones, 944-956 South Rd., Edwardstown, Australia

[21] Appl. No.: 406,557

[22] Filed: Aug. 9, 1982

Related U.S. Application Data

[63] Continuation-in-part of Ser. No. 242,936, Mar. 12, 1981, abandoned.

[51] Int. Cl.[3] ..... F01N 1/02

[52] U.S. Cl. ..... 181/250; 181/272; 181/273

[58] Field of Search ..... 181/250, 266, 267, 273, 181/276, 272

[56] References Cited

U.S. PATENT DOCUMENTS

| | | | |
|---|---|---|---|
| 2,112,964 | 4/1938 | MacKenzie | 181/250 |
| 2,191,619 | 2/1940 | Muller | 181/250 |
| 2,191,620 | 2/1940 | Muller | 181/250 |
| 3,434,565 | 3/1969 | Fischer | 181/250 |

FOREIGN PATENT DOCUMENTS

| | | | |
|---|---|---|---|
| 1265835 | 5/1961 | France | 181/273 |

*Primary Examiner*—Benjamin R. Fuller

*Attorney, Agent, or Firm*—Henry Sternberg; Bert J. Lewen

[57] ABSTRACT

A muffler comprises two Helmholtz resonators, one tuned for high frequency and the other for low frequency. There is a resonance of the high frequency resonator volume's compliance and the effective tail pipe gas inertance which produces an undesirable low frequency noise. This is matched by the resonant frequency of the low frequency resonator, and suppressed thereby. A secondary effect to suppress noise at frequencies above said low frequency resonance due to the tailpipe gas inertance increasing linearly with frequency.

6 Claims, 9 Drawing Figures

LOW FREQUENCY MUFFLER

This is a continuation-in-part of my copending application Ser. No. 242,936, filed Mar. 12, 1981 now abandoned.

This invention relates to a low frequency muffler which is useful for muffling not only high frequency noise, but also low frequency exhaust noise in a motor vehicle, an air conditioning duct, or other conduit through which fluid flows.

BACKGROUND OF THE INVENTION

A problem faces the designer of a muffler for a motor vehicle, where the muffler had to, of necessity, be located behind the rear pair of wheels (or behind the rear axle) with a consequentially short tailpipe. In order to silence high frequencies other designers invariably specified a large muffler volume, with a large acoustic compliance, and with internal devices such as a perforated main flow conduit which have a low acoustical inertance at low frequencies and a high inertance at high frequency. Such an arrangement is satisfactory at high frequencies (over approximately 1000 Hz), however, the compliance of the muffler volume is in resonance with the inertance of the gas in the short tailpipe at a particular low frequency, usually in the range 30 to 100 Hz with typical dimensions in practical use. There is thus a frequency range, centred about this resonance for which the insertion loss becomes very poor and the radiated exhaust noise becomes high.

An obvious solution to the problem is to increase the tailpipe length considerably to increase the tailpipe inertance and thereby place the problem resonance well below the operating range of frequencies. This was the approach of Ishida in Australian Patent application No. 48297/79. In that specification the tailpipe was lengthened by taking it out of the front head plate of the muffler and, with a nearly 180 degree bend, taking it to the rear of the vehicle, thereby lengthening the tailpipe considerably but at considerable expense. This arrangement has been regarded by some as being clumsy and expensive, and in some applications, as being very inconvenient.

Another difficulty encountered is the provision of a muffler to be effective at frequencies ranging from above the low frequency (suppressed) resonance to those for which the tailpipe itself is of the other of half a wavelength long.

By incorporating a high frequency side-branch Helmholtz resonator, as a muffler upstream of a short tailpipe, exhaust noise at frequencies near the Helmholtz resonance frequency of very approximately 1000 Hz is greatly attenuated, whereas low frequency sound near 50 Hz is poorly attenuated or even intensified. This greater low frequency sound is related to the resonance of the Helmholtz resonator volume's compliance and the tailpipe gas's inertance, notwithstanding the fact that the Helmholtz resonance frequency of the muffler as a side-branch is high. By incorporating an additional side-branch Helmholtz resonator within the same muffler housing with a Helmholtz resonance frequency near to that of the low frequency intensified sound, not only does a great attenuation of the low frequency sound result, but attenuation of sound now results over the entire relevant audible range.

BRIEF SUMMARY OF THE INVENTION

In this invention a muffler comprises two side-branch Helmholtz resonators, one tuned for high frequency and the other for low frequency. Resonance of the high frequency resonator volume's compliance and the effective tailpipe gas inertance produces an undesirable low frequency noise. This is suppressed by the low frequency resonator for which the resonant frequency is matched closely to the frequency of the problem noise.

If the low frequency side-branch Helmholtz resonator volume connects with the main exhaust pipe near the upstream end of the muffler by way of a relatively long tube, a significantly effective low frequency side-branch is made, even when that resonant frequency is as low as 40 to 50 Hz. This occurs as the effective side-branch tube length is increased to nearly the full length of the muffler and so the diameter of the branch tube (or the equivalent to the diameter, in the case of the branch tube being a tube surrounding the main exhaust pipe), which is small compared with its length, may still be large enough to have a significant acoustical effect. This may be seen as the resonant frequency of the low frequency side-branch Helmholtz resonator can be determined by the formula:

$$fr = \sqrt{\frac{D^2C^2.}{V.l.}}$$

where fr = resonant frequency

D = diameter (or equivalent diameter) of branch tube

C = speed of sound

V = volume of resonance chamber l = length of branch tube

Clearly, to achieve a low resonant frequency, the branch tube must be long, and so, to achieve a significant acoustical effect (that is, a significant acoustical impedance mis-match), for which the branch tube diameter must be as large as possible, the branch tube length must then be as great as possible. Also, clearly the resonator volume must be as large as possible, so that this volume is in most instances, larger than the volume for the high frequency side-branch, although this need not necessarily be so for all instances.

The long branch tube together with the resonator volume then constitute a low-frequency side-branch resonator which provides an acoustical impedance mismatch at low frequencies, thereby achieving the low frequency muffling action.

BRIEF DESCRIPTION OF THE DRAWINGS

Two embodiments of the invention are described hereunder in some detail with reference to and are illustrated in the accompanying drawings, in which.

Figure 1:
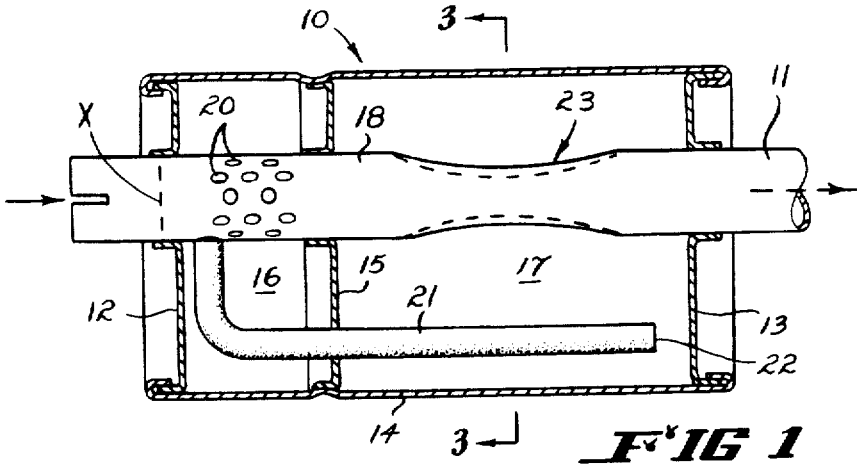
FIG. 1 is a longitudinal section through a muffler according to a first embodiment wherein the gas flow conduit to the larger side-branch Helmholtz resonator is defined by the walls of a tube.
Figure 2:
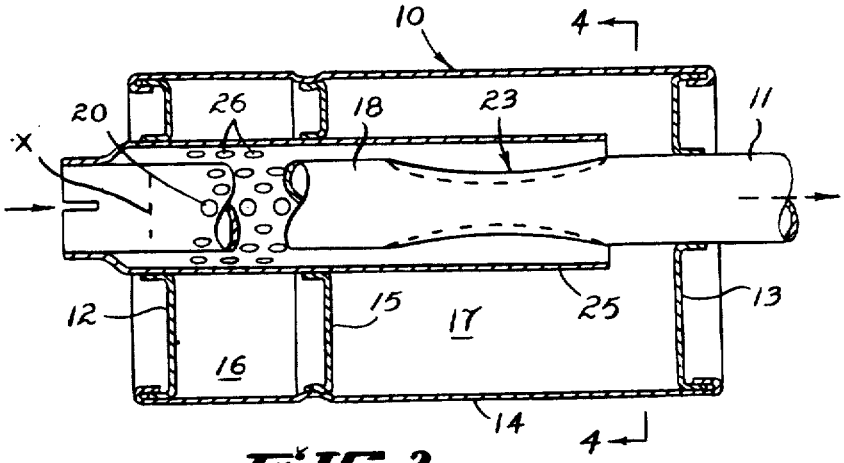
FIG. 2 is a longitudinal section through a muffler according to a second embodiment wherein the gas flow conduit is annular, being defined between the walls of the exhaust pipe and surrounding tube.
Figure 3:
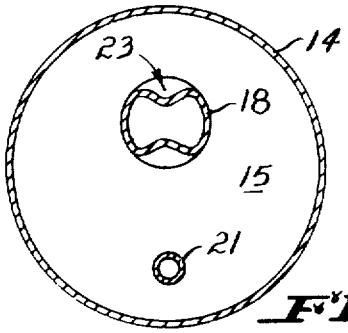
FIG. 3 is a section taken on line 3—3 of FIG. 1.

In the first embodiment of FIGS. 1 and 3, a muffler 10 is arranged for positioning near the rear end of a vehicle and therefore has a short tail pipe 11. Such an arrangement usually results in a low frequency resonance, in the range of 30 to 100 Hz.

The muffler 10 comprises two end walls 12 and 13 and a side wall 14 extending between them, and a division wall 15 part way along the muffler between the end walls, dividing the muffler into a relatively small upstream side-branch Helmholtz resonator 16 and a relatively larger downstream side-branch Helmholtz resonator 17. A main exhaust pipe 18 extends through the length of the muffler 10, terminating at its front end in a connector for connecting to the rear end of an engine exhaust pipe (not shown), and at its rear end is the outwardly extending short tailpipe 11. The main exhaust pipe 18 within the small front side-branch Helmholtz resonator is provided with apertures 20 so that the resonator 16 functions in the normal way for some high frequency noises. Near the front end of the muffler 10 within the space defined by the muffler walls, a branch tube 21 enters the main exhaust pipe 18. This branch tube is as long as possible extending through the front and rear resonator spaces of the muffler, and terminating at its rear end 22 a short distance forwardly of the rear muffler wall.

Figure 4:
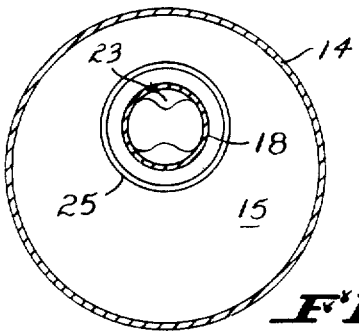
FIG. 4 is a section taken on line 4—4 of FIG. 2.
Figure 8:
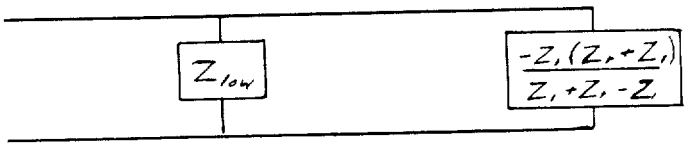
FIG. 8 is a further equivalent to FIG. 7.

The main exhaust pipe 18 has its walls deformed inwardly to form a restrictor 23 of general "figure 8" cross-section as shown in FIGS. 3 and 4. This restrictor configuration is particularly useful because the cross-sectional gas flow area can be made to change so slowly that, in the embodiment illustrated, the region of the exhaust pipe 18 immediately downstream of the restrictor functions (to some extent at least) as a diffuser.

The long branch tube 21 together with the relatively large volume of the Helmholtz resonator 17 constitute a low frequency side-branch resonator.

An acoustical impedence mis-match is achieved, the low frequency sound energy being reflected back to the entry point X of the exhaust pipe into the muffler. The use of a long tube with a sufficiently large cross-sectional area leading into the large Helmholtz resonator volume enables an effective acoustical impedance mismatch to be achieved, and this invention has been found surprisingly effective in suppressing the low frequency resonance.

In the second embodiment, the branch tube 25 is a relatively large diameter tube which surrounds the muffler exhaust pipe 18 such that the gas flow conduit is defined by the annular space between the walls of the pipe 18 and tube 25. For gas flow into the smaller upstream resonator 16, the front ends of both the exhaust pipe 18 and the branch tube 25 are provided with apertures 20 and 26 respectively, such that the branch tube 25 opens into the exhaust pipe 18 through the apertures 20. The equivalent diameter (D in the formula quoted above) of the branch tube 25 is the diameter of a circle of area equal to the annular area of the space between the branch tube 25 and the exhaust pipe 18.

The division wall 15 functions as a stiffener in both embodiments.

At frequencies above the resonance of the tailpipe gas inertance and the high frequency side-branch volume compliance, silencing tends to occur as the oscillation of the gas in the tailpipe is suppressed since the inertance of the gas in the tailpipe becomes very large, this inertance increasing linearly with frequency. Additionally, the placement of the restriction 23 in the tailpipe in the muffler acts to increase the inertance of the gas in the tailpipe and lower the resonance frequency, with the low frequency side-branch tuned to the resultant resonance frequency, so that the forced tailpipe oscillation at frequencies above this resonance will be further suppressed by virtue of said frequencies being further removed above the resonance. The resonance of the tailpipe gas inertance with muffler volume compliance is analogous with the resonance of a spring-mass system and the above theoretical description may be understood further with reference to standard "vibration" text books (for example, "Mechanical Vibrations" by A. H. Church, published by Wiley 1963). At high frequencies, for which the tailpipe is a multiple of half wavelengths in length and may no longer be regarded as having a lumped inertance, of course, sound transmission tends to occur, although in this invention it is suppressed by the high frequency side-branch Helmholtz resonator. The muffler then is thereby effective across a very large frequency range.

The understanding of the invention may be enhanced by consideration of the electrical analogue shown in FIGS. 5, 6, 7, 8 and 9.

Figure 5:
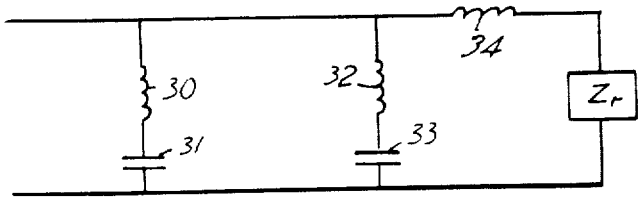
FIG. 5 is a drawing of an analogous electrical circuit.

In FIG. 5 the low frequency side-branch resonator 17 is shown as inductance 30 in series with capacitor 31 (electrical inductance being analogous to acoustical inertance and electrical capacitance to acoustical compliance). Similarly the high frequency side-branch resonator 16 is shown as inductance 32 in series with capacitance 33. The effective tailpipe (that portion which extends from apertures 20 to the end of the pipe) is shown as inductance 34, and the surroundings as having impedance Zr.

Figure 6:
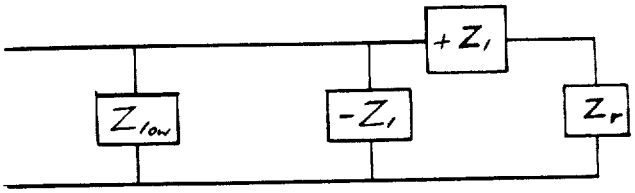
FIG. 6 is an equivalent summary of the impedances of FIG. 5.

At the relevant low frequencies the inductance 32 may be considered to be zero. At resonance of the effective tailpipe with the volume of the high frequency side-branch, the impedance of resonator 16 is essentially capacitance and is shown in FIG. 6 as $(-Z_1)$ whereas the tailpipe impedance is inductive and is shown as $(+Z_1)$. (The two impedances are equal in amplitude and opposite in sign at resonance).

As shown in FIG. 6, $Z_1$ is imaginary, being of the form $$\frac{jpwl}{A}$$

where p is the gas density, w is the frequency (radians per second), l is the tailpipe length, A is the area of the tailpipe cross-section, and j is the square root of $-1$.

Figure 7:
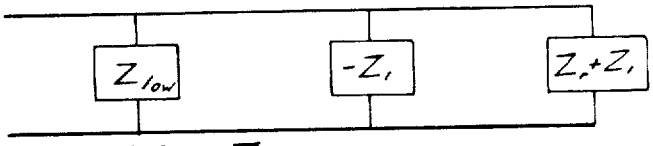
FIG. 7 is an equivalent to FIG. 6.
Figure 9:
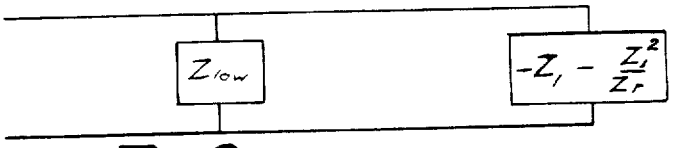
FIG. 9 is the resultant of FIG. 8, following arithmetical manipulation.

Therefore, after the mathematical steps of FIGS. 7, 8 and 9 have been taken, the impedance at resonance looking to the tailpipe side of the point where the low frequency side-branch is attached, is $$-Z_1 - \frac{Z_1^2}{Zr}$$

$Z_1$ is imaginary, so that $Z_1^2$ is real and negative. Also, Zr is essentially imaginary and positive and is known to be much less in magnitude than $Z_1$, so that $$\frac{-Z_1^2}{Zr}$$

is a very large magnitude negative imaginary number and much greater in magnitude compared with $Z_1$.

Since $Z_1$ is in the form shown above, $$\frac{-Z_1^2}{Zr} = \frac{-j^2p^2w^2l^2}{ZrA^2} = \frac{p^2w^2l^2}{ZrA^2}$$

This confirms mathematically that $$\frac{-Z_1^2}{Zr}$$

is an imaginary negative, very large number.

Therefore the high frequency side branch, tailpipe and atmospheric termination, at tailpipe and high frequency resonator resonance, appear as a large magnitude impedance to the low frequency side-branch. At resonance of the tailpipe and the volume of the high frequency resonator, the low frequency side-branch is also at resonance so that Z (low) is zero (except for a small resistance). Therefore the low frequency side branch very effectively shunts out the tailpipe with a large impedance mis-match.

One test conducted showed a reduction of about 20 dB in noise from a multicylinder engine.

I claim:

1. A muffler comprising a first and a second Helmholtz resonator, the first having a relative volume compliance and relatively high resonance frequency and the second having a relatively low resonance frequency;

a main exhaust pipe and a tail pipe having a relative acoustical instance, the mean exhaust pipe being in gas flow communication with each said resonator, and in gas flow communication with said tail pipe, and wherein the acoustical inertance of the tail pipe and the compliance of the high resonance frequency resonator being such that said low resonance frequency substantially matches the resonance of the combination of said high resonance frequency resonator volume's compliance and said tail pipe acoustical inertance.

2. A muffler according to claim 1 comprising a muffler housing, said main exhaust pipe extending through the muffler housing, means securing said main exhaust pipe to the housing, and a division wall dividing the housing into said two Helmholtz resonators, each of which is a side-branch resonator, at least one aperture extending through the wall of the main exhaust pipe at the upstream end of said muffler and placing the interior of the exhaust pipe into gas flow communication with said relatively high resonance frequency resonator, and, a branch tube of the main exhaust pipe which extends almost to the downstream end wall of the muffler and opens into said relatively low resonance frequency resonator, the other end of said branch tube opening into said interior of the exhaust pipe near the upstream end of the muffler.

3. A muffler according to claim 2 wherein said branch tube is secured to the wall of said exhaust pipe and extends through said division wall.

4. A muffler according to claim 2 wherein said branch tube comprises a tube of larger diameter than the exhaust pipe which surrounds the exhaust pipe for most of its length within said muffler and defines therewith a gas flow conduit which opens at its rear end in said other of said resonators, the front end only of the branch tube and the front end of the exhaust pipe both having apertures extending through their respective walls near the front end of said muffler.

5. A muffler according to claim 2 wherein said exhaust pipe contains a restrictor in said muffler.

6. A muffler according to claim 5 wherein said restrictor is defined by the walls of the exhaust pipe which forms a general "figure 8" cross-sectional shape for portion only of its length and is circular for the remaining portion of its length.

* * * * *